US008357062B2

(12) United States Patent
Lim et al.

(10) Patent No.: US 8,357,062 B2
(45) Date of Patent: Jan. 22, 2013

(54) GAME BALL

(75) Inventors: Chee-Aun Lim, Singapore (SG); Eng @ Tham-Eng Ng, Singapore (SG)

(73) Assignee: Singaball Pte. Ltd., Singapore (SG)

( * ) Notice: Subject to any disclaimer, the term of this patent is extended or adjusted under 35 U.S.C. 154(b) by 240 days.

(21) Appl. No.: 12/773,079

(22) Filed: May 4, 2010

(65) Prior Publication Data

US 2011/0275463 A1 Nov. 10, 2011

(51) Int. Cl.
*A63B 39/00* (2006.01)

(52) U.S. Cl. ..... 473/613

(58) Field of Classification Search ..... 473/613, 473/595, 596, 597, 600, 612, 280, 281, 451; D21/713

See application file for complete search history.

(56) References Cited

U.S. PATENT DOCUMENTS

| | | | | | |
|---|---|---|---|---|---|
| 1,483,165 | A * | 2/1924 | Eaton | 473/281 |
| 2,211,330 | A * | 8/1940 | Hochberg | 473/280 |
| 2,597,704 | A * | 5/1952 | Carlson | 473/604 |
| 2,776,139 | A * | 1/1957 | Blamey, Jr. et al. | 473/613 |
| 3,908,994 | A * | 9/1975 | Astrom | 473/613 |
| 4,088,319 | A * | 5/1978 | Clarke | 473/575 |
| D287,988 | S * | 1/1987 | Billinghurst | D21/713 |
| 5,280,906 | A * | 1/1994 | Vitale | 473/613 |
| 5,611,532 | A * | 3/1997 | Forrest, Sr. | 473/576 |
| 5,700,211 | A * | 12/1997 | Mackie | 473/613 |
| 6,098,571 | A * | 8/2000 | Axelrod et al. | 119/707 |
| D479,897 | S * | 9/2003 | Willinger | D21/712 |
| 6,723,013 | B2 * | 4/2004 | Ilcisin et al. | 473/570 |
| 6,837,814 | B2 * | 1/2005 | Thomas | 473/613 |
| D514,263 | S * | 1/2006 | Willinger | D30/160 |
| 7,608,003 | B1 * | 10/2009 | Fusco et al. | 473/613 |
| 2009/0137350 | A1 * | 5/2009 | Lenig | 473/451 |

* cited by examiner

*Primary Examiner* — Steven Wong

(74) *Attorney, Agent, or Firm* — McDonnell Boehnen Hulbert & Berghoff LLP

(57) ABSTRACT

Hollow balls with a hard shell, for example the game ball used in the pickle ball game, are used in various racquet games. One example of such hollow balls is the game ball used in the pickle ball game. These hollow balls break after a period of use or when excessive force is applied to the hollow ball. A game ball is described herein with a first plurality of apertures and a second plurality of apertures. Each of the first plurality of apertures is dimensionally different from each of the second plurality of apertures and inter-configured to reduce damage to the game ball during use thereof.

12 Claims, 3 Drawing Sheets

GAME BALL

FIELD OF INVENTION

The present invention relates generally to a game ball for used in racquet ball games.

BACKGROUND

Hollow balls with a hard shell, for example the game ball used in the pickle ball game, are used in various racquet games. One example of such hollow balls is the game ball used in the pickle ball game. The hollow ball typically contains a plurality of apertures to facilitate flight through the air during racquet game-play. However, since these hollow balls are manufactured in two parts and joined along a parting line, they tend to break after a period of use or when excessive force is applied to the hollow ball. Therefore, there exists a need for an improved game ball for use in racquet ball games.

SUMMARY

In accordance with a first aspect of the invention, there is disclosed a game ball comprising a hollow shell defining a first plurality of apertures and a second plurality of apertures. Each of the first plurality of apertures is dimensionally different from each of the second plurality of apertures.

In accordance with a second aspect of the invention, there is disclosed a game ball comprising a hollow shell. The hollow shell defines a first plurality of apertures and a second plurality of apertures. The hollow shell has a first hemisphere and a second hemisphere interfacing along an equatorial line. Each of the first hemisphere and the second hemisphere has a portion of the first plurality of apertures spaced therearound. At least a portion of the second plurality of apertures is spaced substantially adjacent the equatorial plane for segregating the portion of the first plurality of apertures spaced around the first hemisphere from the portion of the first plurality of apertures spaced around the second hemisphere with each of the first plurality of apertures being dimensionally larger than each of the second plurality of apertures.

DETAILED DESCRIPTION

Figure 1:
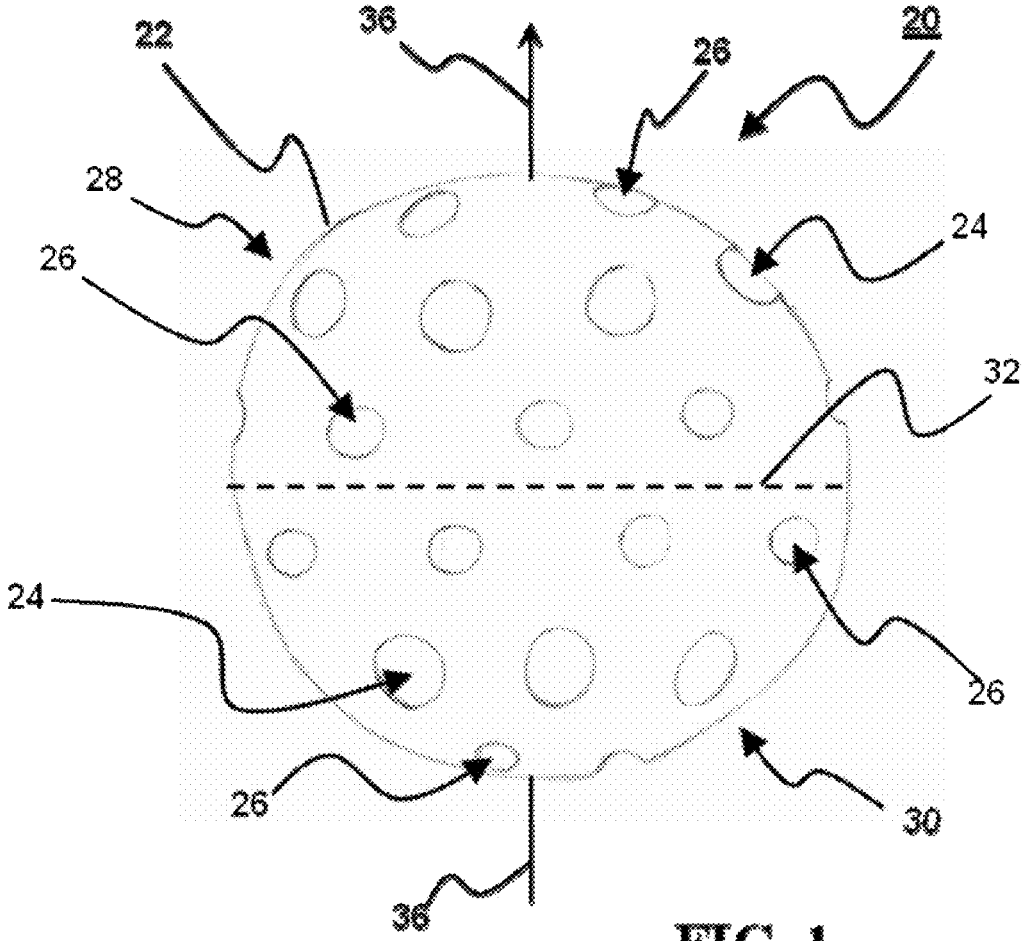
FIG. 1 shows a partial from elevation of a game ball according to an embodiment of the invention.
Figure 2:
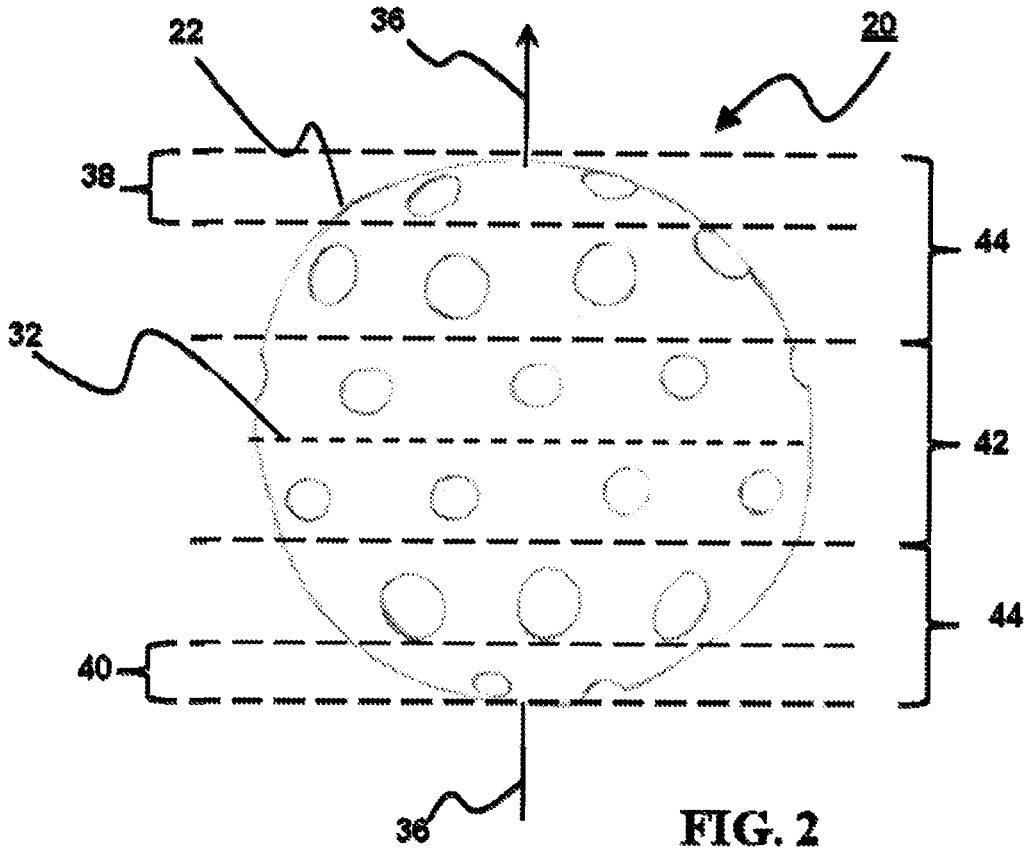
FIG. 2 shows a partial from elevation of the game ball of FIG. 1 with a equatorial portion, bounding portions, a first pole portion and a second pole portion being illustrated.
Figure 3:
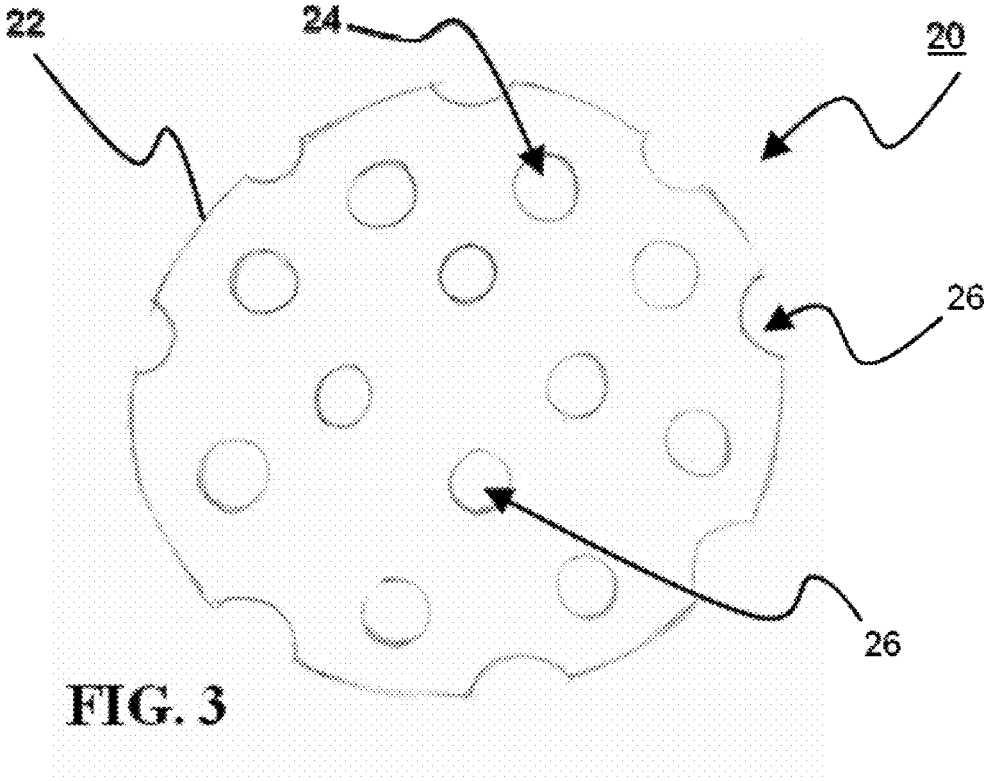
FIG. 3 shows a partial plan view of the game ball of FIG. 1.

A first exemplary embodiment of the present invention, a game ball 20, is described hereinafter with reference to FIG. 1 and FIG. 2.

The game ball comprises a hollow shell 22 defining a first plurality of apertures 24 and a second plurality of apertures 26. Preferably, the hollow shell 22 is substantially spherical in shape. The hollow shell 22 comprises a first hemisphere 28 and a second hemisphere 30 interfacing along an equatorial line 32. Preferably, the hollow shell 22 is the same size as a regulation-compliant game ball used in a pickle ball game. Alternatively, the hollow shell 22 is formable with any dimensions.

Preferably, the equatorial line 32 defines an equatorial plane (not shown) having a reference axis 36 substantially perpendicular thereto. The reference axis 36 coincides substantially with the geometric centre of the hollow shell 22. The reference axis 36 intersects the first hemisphere 28 and the second hemisphere 30 at a first pole portion 38 and a second pole portion 40 respectively. The hollow shell 22 comprises an equatorial portion 42 extending substantially over and along the equatorial line 32. Each of the first hemisphere 28 and the second hemisphere 30 has a portion of the first plurality of apertures 24 arranged therearound. The portion of the first plurality of apertures 24 is disposed away from the equatorial portion 42 of the hollow shell 22. Preferably, each of the first hemisphere 28 and the second hemisphere 30 has one ring of eight of the first plurality of apertures 24 equally spaced around the reference axis 36.

The hollow shell 22 comprises two bounding portions 44 with the equatorial portion 42 interposing the two bounding portions 44. Preferably, each of the first plurality of apertures 24 is positioned within one of the two bounding portions 44. Preferably, each of the first pole portion 38 and the second pole portion 40 constitute a portion of one of the two bounding portions 44. The hollow shell 22 is preferably structurally seamless.

The equatorial portion 42 of the hollow shell 22 has at least a portion of the second plurality of apertures 26 arranged therealong. Preferably, the equatorial portion 42 has two row of eight of the second plurality of apertures 26 equally spaced around the reference axis 36. Each of the first pole portion 38 and the second pole portion 40 has a portion of the second plurality of apertures 26. Preferably, each of the first pole portion 38 and the second pole portion 40 of the hollow shell 22 has four of the second plurality of apertures spaced around the reference axis 36.

Each of the first plurality of apertures 24 is dimensionally larger than each of the second plurality of apertures 26. Preferably, each of the first plurality of apertures 24 and the second plurality of apertures are circular in shape.

The hollow shell 22 is preferably made of plastic or polymeric material, for example, resin and polyethylene. The hollow shell may be manufactured as one sphere or as two semi-spheres which are joined together. The first plurality of apertures 24 and the second plurality of apertures 26 are formed during molding of the hollow shell 22 or via drilling of the hollow shell 22. The first plurality of apertures 24 are shaped, dimensioned and configured to enable sufficient airflow therethrough during game-play use with each thereof not exceeding dimensions that may reduce the bouncability of the game ball 20 beyond what is typically required during game-play. The second plurality of apertures 26 are dimensioned and configured for occupying a portion of regions of the hollow shell 22 not occupied by the first plurality of aperture 26.

For dimensional illustration, the hollow shell 22 is preferably 75 mm in diameter with each of the first plurality of apertures being substantially 8.5 mm in diameter and each of the second plurality of apertures being 7 mm in diameter.

The above described configuration of the first plurality of apertures 24 and the second plurality of apertures 26 preferably reduces contact area of the hollow shell 22 during impact thereof with a surface, and increases the smallest width between any adjacent pair of the first plurality of apertures 24 and the second plurality of apertures. This enables local deflection of the hollow shell 22 while reducing stress concentration at any given point on the hollow shell 22 which consequently reduces breakage of the hollow shell during game play.

Additionally, the use of the second plurality of apertures 26 along the equatorial portion 42 of the hollow shell 22 allows for a larger distance between any adjacent pair of the second plurality of apertures 26 when compared with use of the dimensionally larger first plurality of apertures 24. This results in more material existing in the equatorial portion 42 which contributes to the better structural integrity of the equatorial portion 42 of the hollow shell 22. This is important especially when the hollow shell 22 is manufactured as two semi-spheres and joined at a seam forming the equatorial line 32. The increased distance between any adjacent pair of the second plurality of apertures 26 substantially reduces breakage occurring along the equatorial line 32. The hollow shell 22 is preferably manufactured by roto-molding.

In the foregoing manner, a game ball is described according to an exemplary embodiment of the present invention. Although only one exemplary embodiment of the present invention are disclosed, it will be apparent to a person skilled in the art in view of this disclosure that numerous changes and/or modifications can be made without departing from the scope and spirit of the present invention.

We claim:

1. A game ball comprising:

a hollow shell being substantially spherical and defining an equatorial line dividing the hollow shell into a first hemisphere and a second hemisphere, the hollow shell further comprising an equatorial portion extending substantially along the equatorial line on both the first hemisphere and the second hemisphere, the hollow shell further defining a first plurality of apertures and a second plurality of apertures, the first plurality of apertures being dimensionally larger than the second plurality of apertures, and the equatorial portion comprising a portion of the second plurality of apertures such that each aperture in the equatorial portion is fully disposed within the equatorial portion, with the first plurality of apertures disposed away from the equatorial portion.

2. The ball as in claim 1, wherein the first plurality of apertures and the second plurality of apertures are similarly shaped.

3. The ball as in claim 1, wherein the hollow shell is substantially hard.

4. The ball as in claim 1, wherein the hollow shell is made from resin.

5. The ball as in claim 1, wherein the equatorial line defines an equatorial plane, the equatorial line and the equatorial plane being coplanar, further comprising a reference axis perpendicular to the equatorial plane.

6. The ball as in claim 1, the hollow shell comprising two bounding portions, one on each of the first hemisphere and the second hemisphere, the equatorial portion being interposed by the bounding portions, and wherein each of the two bounding portions comprising a portion of the first plurality of apertures.

7. The ball as in claim 6, wherein each of the two bounding portions includes a pole portion wherewith the reference axis intersects, the pole portion of each of the two bounding portions comprising another portion of the second plurality of apertures.

8. The ball as in claim 7, wherein the equatorial portion comprises eight of the second plurality of apertures on each of the first hemisphere and the second hemisphere.

9. The ball as in claim 8, wherein each of the two bounding portions comprises one ring of eight of the first plurality of apertures extending around the reference axis and the pole portion of each of the two bounding portions comprises four of the second plurality of apertures extending around the reference axis.

10. The ball as in claim 1, wherein each of the first plurality of apertures and each of the second plurality of apertures are substantially circularly-shaped.

11. A game ball comprising a hollow shell, the hollow shell defining a first plurality of apertures and a second plurality of apertures, the hollow shell having a first hemisphere and a second hemisphere interfacing along an equatorial line, the hollow shell further comprising an equatorial portion extending substantially along the equatorial line on both the first hemisphere and the second hemisphere, each of the first hemisphere and the second hemisphere having a portion of the first plurality of apertures spaced therearound, the equatorial portion comprising a portion of the second plurality of apertures only for segregating the portion of the first plurality of apertures spaced around the first hemisphere from the portion of the first plurality of apertures spaced around the second hemisphere, each of the first plurality of apertures being dimensionally larger than each of the second plurality of apertures.

12. The ball as in claim 11, wherein each of the first plurality of apertures and each of the second plurality of apertures has a circular shape.

* * * * *